US006263846B1

(12) United States Patent
Simpson et al.

(10) Patent No.: US 6,263,846 B1
(45) Date of Patent: Jul. 24, 2001

(54) CONTROL VALVE STRATEGY FOR VANE-TYPE VARIABLE CAMSHAFT TIMING SYSTEM

(75) Inventors: Roger T. Simpson, Ithaca; Frank R. Smith, Cortland, both of NY (US)

(73) Assignee: BorgWarner Inc., Troy, MI (US)

( * ) Notice: Subject to any disclaimer, the term of this patent is extended or adjusted under 35 U.S.C. 154(b) by 0 days.

(21) Appl. No.: 09/592,624

(22) Filed: Jun. 13, 2000

Related U.S. Application Data

(60) Provisional application No. 60/173,331, filed on Dec. 28, 1999.

(51) Int. Cl.[7] ..... F01L 1/344

(52) U.S. Cl. ..... 123/90.17; 74/568 R

(58) Field of Search ..... 123/90.15, 90.17, 123/90.31; 75/568 R; 464/1, 2, 160

(56) References Cited

U.S. PATENT DOCUMENTS

| | | | | |
|---|---|---|---|---|
| 2,861,557 | | 11/1958 | Stolte . | |
| 4,858,572 | | 8/1989 | Shiraii et al. . | |
| 5,271,360 | * | 12/1993 | Kano et al. | 123/90.17 |
| 5,435,782 | * | 7/1995 | Tortul | 464/2 |
| 5,797,361 | | 8/1998 | Mikame et al. . | |
| 5,836,275 | | 11/1998 | Sato . | |
| 5,941,202 | * | 8/1999 | Jung | 123/90.17 |
| 6,024,062 | * | 2/2000 | Kako et al. | 123/90.17 |
| 6,035,819 | * | 3/2000 | Nakayoshi et al. | 123/90.17 |
| 6,053,138 | | 4/2000 | Trzmiel et al. | 123/90.17 |
| 6,053,139 | * | 4/2000 | Eguchi et al. | 123/90.17 |
| 6,058,897 | * | 5/2000 | Nakayoshi | 123/90.17 |
| 6,085,708 | | 7/2000 | Trzmiel et al. | 123/90.17 |
| 6,105,543 | | 8/2000 | Ogawa | 123/90.17 |
| 6,129,063 | | 10/2000 | Niethammer et al. | 123/90.17 |

FOREIGN PATENT DOCUMENTS

| | | |
|---|---|---|
| 0 924 391 A2 | 6/1999 | (EP) . |
| 0 924 392 A2 | 6/1999 | (EP) . |
| 0 924 393 A2 | 6/1999 | (EP) . |

* cited by examiner

*Primary Examiner*—Wellun Lo
(74) *Attorney, Agent, or Firm*—Emch, Schaffer, Schaub & Porcello Co., L.P.A.; Greg Dziegielewski

(57) ABSTRACT

An internal combustion engine includes a camshaft (40) and hub (30) secured to the camshaft (40) for rotation therewith, where a housing (20) circumscribes the hub (30) and is rotatable with the hub (30) and the camshaft (40), and is further oscillatable with respect to the hub (30) and camshaft (40). Driving vanes (22) are radially inwardly disposed in the housing (20) and cooperate with the hub (30), while driven vanes (32) are radially outwardly disposed in the hub (30) to cooperate with the housing (20) and also circumferentially alternate with the driving vanes (22) to define circumferentially alternating advance and retard chambers (28A/28R). A configuration for controlling the oscillation of the housing (20)relative to the hub (30) includes an electronic engine control unit (70), and an advancing control valve (50) that is responsive to the electronic engine control unit (70)and that regulates engine oil pressure to and from the advance chambers(28A). A retarding control valve (60) responsive to the electronic engine control unit (70) regulates engine oil pressure to and from the retard chambers (28R). An advancing passage (44) communicates engine oil pressure between the advancing control valve (50) and the advance chambers (28A), while a retarding passage (46) communicates engine oil pressure between the retarding control valve (60) and the retard chambers(28R).

23 Claims, 6 Drawing Sheets

CONTROL VALVE STRATEGY FOR VANE-TYPE VARIABLE CAMSHAFT TIMING SYSTEM

CROSS-REFERENCES

The present application is based in part on co-pending provisional patent application Ser. No. 60/173,331, filed on Dec. 28, 1999, and is related to co-pending application Ser. No. 09/450,456 filed Nov. 29, 1999, and entitled "Variable Valve Timing with Actuator Locking for Internal Combustion Engine", by inventor Roger T. Simpson.

Additionally, the present application is related to copending application Ser. No. 09/473,804 filed on Dec. 28, 1999, and entitled "Multi-Position Variable Cam Timing System Actuated by Engine Oil Pressure", by inventors Roger T. Simpson, Michael Duffield, and Marty Gardner and thus is incorporated by reference herein. Finally, the present application is related to co-pending provisional application Ser. No. 60/173,330 filed on Dec. 28, 1999, and entitled "Multi-Position Variable Cam Timing System having a Vane-Mounted Locking-Piston Device", by inventors Roger T. Simpson and Michael Duffield and thus is also incorporated by reference herein.

BACKGROUND OF THE INVENTION

1. Field of the Invention

The present invention generally relates to an internal combustion engine having an hydraulic control system for controlling the operation of a variable camshaft timing (VCT) mechanism of the type in which the position of the camshaft is circumferentially varied relative to the position of a crankshaft in reaction to engine oil pressure. More specifically, this invention relates to a VCT electro-hydraulic control system wherein a pair of solenoid control valves is employed to selectively advance, retard, or maintain the position of the camshaft.

2. Description of the Prior Art

It is known that the performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven by a single crankshaft-powered chain drive or belt drive. It is also known that the performance of an internal combustion engine having dual camshafts, or but a single camshaft, can be improved by changing the positional relationship of a camshaft relative to the crankshaft.

It is also known that engine performance in an engine having one or more camshafts can be improved, specifically in terms of idle quality, fuel economy, reduced emissions, or increased torque. For example, the camshaft can be "retarded" for delayed closing of intake valves at idle for stability purposes and at high engine speed for enhanced output. Likewise, the camshaft can be "advanced" for premature closing of intake valves during mid-range operation to achieve higher volumetric efficiency with correspondingly higher levels of torque. In a dual-camshaft engine, retarding or advancing the camshaft is accomplished by changing the positional relationship of one of the camshafts, usually the camshaft that operates the intake valves of the engine, relative to the other camshaft and the crankshaft.

Accordingly, retarding or advancing the camshaft varies the timing of the engine in terms of the operation of the intake valves relative to the exhaust valves, or in terms of the operation of the valves relative to the position of the crankshaft.

Heretofore, many VCT systems incorporated hydraulics including an oscillatable vane having opposed lobes and being secured to a camshaft within an enclosed housing. Such a VCT system often includes fluid circuits having check valves, a spool valve and springs, and electromechanical valves to transfer fluid within the housing from one side of a vane lobe to the other, or vice versa, to thereby oscillate the vane with respect to the housing in one direction or the other. Such oscillation is effective to advance or retard the position of the camshaft relative to the crankshaft. These VCT systems are typically "self-powered" and have a hydraulic system actuated in response to torque pulses flowing through the camshaft.

Unfortunately, the above VCT systems may have several drawbacks. One drawback with such VCT systems is the requirement of the set of check valves and the spool valve. The check valves are necessary to prevent back flow of oil pressure during periods of torque pulses from the camshaft. The spool valve is necessary to redirect flow from one fluid chamber to another within the housing. Using these valves involves many expensive high precision parts that further necessitate expensive precision machining of the camshaft.

Additionally, these precision parts may be easily fouled or jammed by contamination inherent in hydraulic systems. Relatively large contamination particles often lodge between lands on the spool valve and lands on a valve housing to jam the valve and render the VCT inoperative. Likewise, relatively small contamination particles may lodge between the outer diameter of the check or spool valve and the inner diameter of the valve housing to similarly jam the valve. Such contamination problems are typically approached by targeting a "zero contamination" level in the engine or by strategically placing independent screen filters in the hydraulic circuitry of the engine. Such approaches are known to be relatively expensive and only moderately effective to reduce contamination.

Another problem with such VCT systems is the inability to properly control the position of the spool during the initial start-up phase of the engine. When the engine first starts, it takes several seconds for oil pressure to develop. During that time, the position of the spool valve is unknown. Because the system logic has no known quantity in terms of position with which to perform the necessary calculations, the control system is prevented from effectively controlling the spool valve position until the engine reaches normal operating speed.

Finally, it has been discovered that such types of VCT system are not optimized for use with all engine styles and sizes. Larger, higher-torque engines such as V-8's produce torque pulses sufficient to actuate the hydraulic system of such VCT systems. Regrettably however, smaller, lower-torque engines such as four and six cylinders may not produce torque pulses sufficient to actuate the VCT hydraulic system.

Other VCT systems incorporate system hydraulics including a hub having multiple circumferentially spaced vanes cooperating within an enclosed housing having multiple circumferentially opposed walls. The vanes and the walls cooperate to define multiple fluid chambers, and the vanes divide the chambers into first and second sections. For example, Shirai et al., U.S. Pat. No. 4,858,572, teaches use of such a system for adjusting an angular phase difference between an engine crankshaft and an engine camshaft. Shirai et al. further teaches that the circumferentially opposed walls of the housing limit the circumferential travel of each of the vanes within each chamber.

Shirai et al. discloses fluid circuits having check valves, a spool valve and springs, and electromechanical valves to transfer fluid within the housing from the first section to the second section, or vice versa, to thereby oscillate the vanes and hub with respect to the housing in one direction or the other. Shirai et al. further discloses a first connecting means for locking the hub and housing together when each vane is in abutment with one of the circumferentially opposed walls of each chamber. A second connecting means is provided for locking the hub and housing together when each vane is in abutment with the other of the circumferentially opposed walls of each chamber. Such connecting means are effective to keep the camshaft position either fully advanced or fully retarded relative to the crankshaft.

Unfortunately, Shirai et al. has several shortcomings. First, the previously mentioned problems involved with using a spool valve and check valve configurations are applicable to Shirai et al. Second, this arrangement appears to be limited to a total of only 15 degrees of phase adjustment between crankshaft position and camshaft position. The more angle of cam rotation, the more opportunity for efficiency and performance gains. Thus, only 15 degrees of adjustment severely limits the efficiency and performance gains compared to other systems that typically achieve 30 degrees of cam rotation. Third, this arrangement is only a two-position configuration, being positionable only in either the fully advanced or fully retarded positions with no positioning in-between whatsoever. Likewise, this configuration limits the efficiency and performance gains compared to other systems that allow for continuously variable angular adjustment within the phase limits.

Another approach to controlling a vane style camshaft phaser is to use a four-way proportional control valve to control oil flow to and from the fluid chambers of the housing. Such valves have two control ports, a supply port, and an exhaust port. A first control port feeds an advance side of each fluid chamber, while a second control port feeds a retard side of each fluid chamber. While the advance sides are being filled with oil the retard sides are being exhausted. Once the desired position of the camshaft is achieved, the valve moves to a null position where both control ports are being supplied with a very small amount of oil. This keeps the vane phaser in a fixed position while a locking mechanism activates to positively lock the vane phaser in position.

Unfortunately, Single Overhead Cam (SOHC) engines having three valves per cylinder tend to produce extraordinarily high camshaft torsional forces that pose problems for four-way proportional valves. One such problem with the four-way valve is that, at null, the flow to the chambers is insufficiently small and easily overcome. Consequently, the high camshaft torsionals cause the phaser to oscillate back and forth thus causing erratic engine operation. In other words, it is difficult for a four-way valve to control phaser dither at null. In addition, since the oil supply to the first control port has the same flow as the second control port to exhaust, the phaser response is only as fast as the advance side can fill and how fast the retard side can exhaust. Finally, This type of valve tends to be prohibitively expensive and requires use of relatively sophisticated electronics.

Therefore, what is needed is a VCT system that is designed to overcome the problems associated with prior art variable camshaft timing arrangements by providing a variable camshaft timing system that performs well with all engine styles and sizes, packages at least as tightly as prior art VCT hardware, eliminates the need for check valves and spool valves, provides for continuously variable camshaft to crankshaft phase adjustment within its operating limits, uses relatively simple and inexpensive control valves, and provides substantially more than fifteen degrees of phase adjustment between the crankshaft position and the camshaft position.

SUMMARY OF THE INVENTION

According to the present invention there is provided a Variable Camshaft Timing (VCT) system that is designed to overcome the problems associated with prior art variable camshaft timing arrangements. The VCT system of the present invention performs well with all engine styles and sizes, packages at least as tightly as prior art VCT hardware, eliminates the need for check valves and spool valves, provides for continuously variable camshaft to crankshaft phase adjustment within its operating limits, uses relatively simple and inexpensive control valves, and provides substantially more than 15° of phase adjustment between the crankshaft position and the camshaft position.

Furthermore, the present invention additionally provides an alternative positive locking mechanism for locking the VCT in position.

In one form of the invention, there is included an internal combustion engine having a camshaft and a hub secured to the camshaft for rotation therewith. A housing circumscribes the hub and is rotatable with the hub and the camshaft and is further oscillatable with respect to the hub and camshaft. Driving vanes are radially inwardly disposed in the housing and cooperate with the hub. Likewise, driven vanes are radially outwardly disposed in the hub to cooperate with the housing and also circumferentially alternate with the driving vanes to define circumferentially alternating advance and retard chambers. A configuration for controlling the oscillation of the housing relative to the hub is provided and includes an electronic engine control unit, and an advancing three-way solenoid control valve that is responsive to the electronic engine control unit. The advancing three-way solenoid regulates engine oil pressure to and from the advance chambers. Similarly, a retarding three-way solenoid that is responsive to the electronic engine control unit regulates engine oil pressure to and from the retard chambers. An advancing passage communicates engine oil pressure between the advancing three-way solenoid and the advance chambers, while a retarding passage communicates engine oil pressure between the retarding 3-way solenoid and the retard chambers.

Accordingly, it is an object of the present invention to overcome the above-mentioned problems with the prior art.

It is another object to provide a VCT system that eliminates the need for spool, check, and four-way proportional valves and instead uses a simpler and less expensive oscillation control system for oscillating or changing the phase of the VCT.

It is yet another object to provide a VCT that packages as tightly as prior art VCT systems by using thin steel vanes to enable packaging of six fluid chambers and enable at least thirty degrees of cam phasing.

It is still another object to provide a VCT having an oscillation control system that controls the advance and retard chambers independently and separately to enable faster, more accurate phasing control and provides for continuously variable phasing adjustment within its operating limits.

It is a further object to provide a VCT that is less susceptible to the influence of camshaft torsional forces, and thus performs well with all engine styles and sizes.

These objects and other features, aspects, and advantages of this invention will be more apparent after a reading of the following detailed description, appended claims, and accompanying drawings.

DETAILED DESCRIPTION OF THE PREFERRED EMBODIMENT

Figure 1:
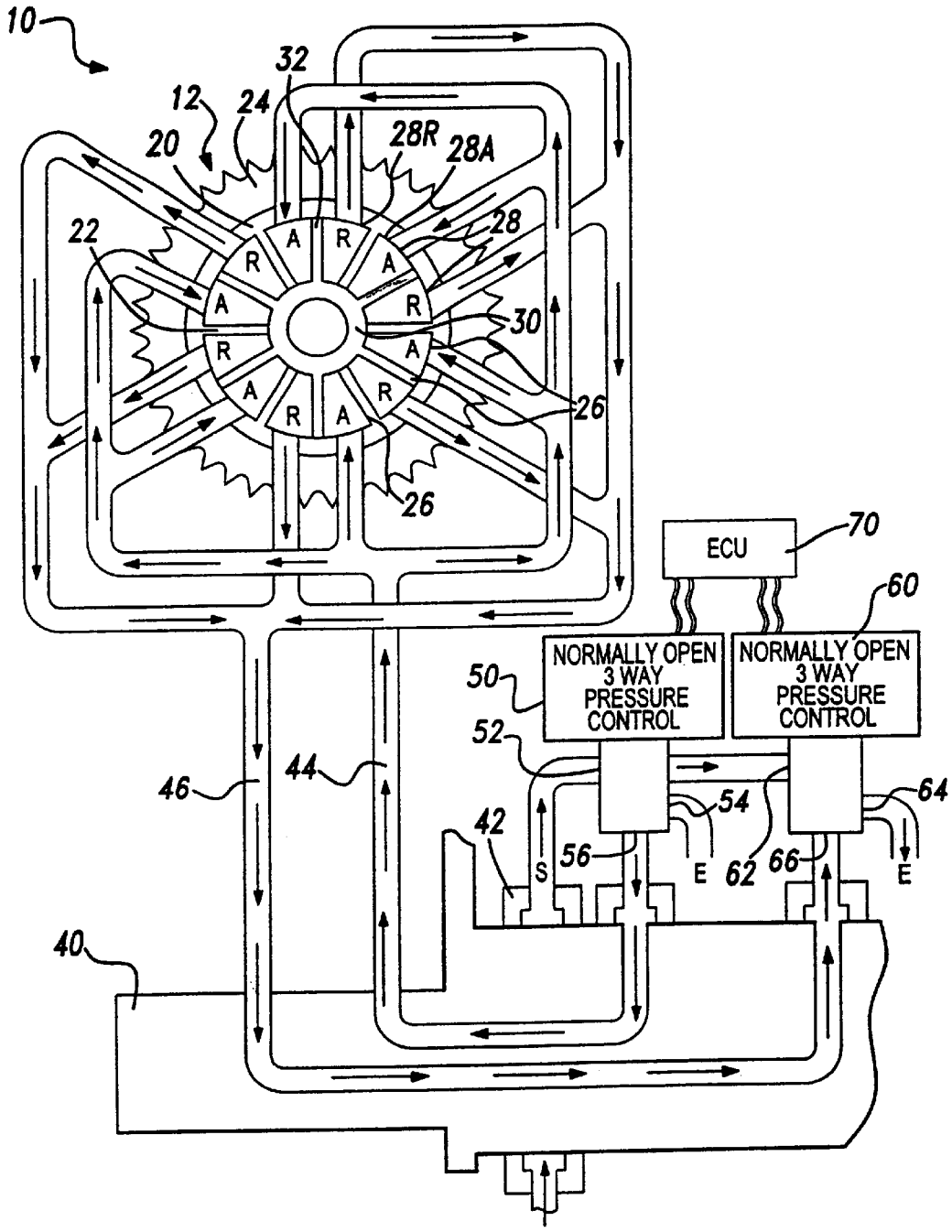
FIG. 1 is a schematic illustration of a Variable Camshaft Timing (VCT) system according to the preferred embodiment of the present invention showing a phase shift to an advance position.

In general, a hydraulic timing system is provided for varying the phase of one rotary member relative to another rotary member. More particularly, the present invention provides a multi-position Variable Camshaft Timing system (VCT) powered by engine oil for varying the timing of a camshaft of an engine relative to a crankshaft of an engine to improve one or more of the operating characteristics of the engine. While the present invention will be described in detail with respect to internal combustion engines, the VCT system is also well suited to other environments using hydraulic timing devices. Accordingly, the present invention is not limited to only internal combustion engines. Referring now in detail to the Figures, there is shown in FIG. 1 a Variable Camshaft Timing system 10 according to the preferred embodiment of the present invention. A vane phaser 12 includes a housing 20 having sprocket teeth 24 circumferentially disposed around its periphery. The housing 20 circumscribes a hub 30 to define an annular space 26 therebetween. The housing 20 includes driving vanes 22 extending radially inwardly and spring biased toward the hub 30 and communicating with the hub 30 to divide the annular space 26 into six fluid chambers 28. Likewise, the hub 30 includes driven vanes 32 extending radially outwardly, being spring biased toward the housing 20, and communicating with the housing 20. The driven vanes 32 are circumferentially interspersed among the driving vanes 22 so as to divide the fluid chambers 28 further into six advance chambers 28A and six retard chambers 28R, fluid tightly separated from one another. Accordingly, the housing 20 is rotatable with the hub 30 and oscillatable with respect thereto.

The hub 30 is keyed or otherwise mechanically secured to a camshaft 40 to be rotatable therewith but not oscillatable with respect thereto and is in fluid communication with the camshaft 40 as is commonly known in the art. The camshaft 40 includes a camshaft bearing 42 circumferentially mounted thereto. The camshaft 40 bearing 42 is fluidly connected to a supply port 52 of a three-way solenoid advance control valve 50 and a supply port 62 of a three-way solenoid retard control valve 60. The advance and retard control valves 50 and 60 each have an exhaust port 54 and 64. The advance control valve 50 has an advance control port 56 in fluid communication with an advancing passage 44 running through the camshaft 40 and into the advance chambers 28A. Likewise, the retard control valve 60 has a retard control port 66 in fluid communication with a retarding passage 46 running through the camshaft 40 and into the retard chambers 28R. An electronic engine control unit 70 is electronically connected to the advance and retard control valves 50 and 60.

In operation, the assembly that includes the camshaft 40 with the hub 30 and housing 20 is caused to rotate by torque applied to the housing 20 by an endless belt (not shown) that engages the sprocket teeth 24 so that rotation is imparted to the endless belt by a rotating crankshaft (also not shown). The use of a cogged timing belt to drive the housing 20 is also contemplated. Rotation, in turn, is imparted from the housing 20 to the hub 30 by the driving vanes 22 of the housing 20 rotatably driving the driven vanes 32 of the hub 30. The driven vanes 32 of the hub 30 can be retarded with respect to the driving vanes 22 of the housing 20, or can be advanced with respect to the driving vanes 22 of the housing 20. Therefore, the housing 20 rotates with the camshaft 40 and is oscillatable with respect to the camshaft 40 to change the phase of the camshaft 40 relative to the crankshaft.

In order to change phase of the camshaft 40, an oscillation control configuration is required. When the engine is started, pressurized engine oil begins to flow through the camshaft bearing 42 and into the advance and retard control valves 50 and 60. The electronic engine control unit 70 processes input information from various sources within the engine and elsewhere, then sends output information to the advance and retard control valves 50 and 60.

As shown in FIG. 1, the camshaft 40 may be shifted in phase toward a fully advanced position. Here, the electronic engine control unit 70 signals the retard control valve 60 to restrict the supply port 62 while opening the exhaust port 64, thereby permitting engine oil to exhaust from the retard chambers 28R through the retarding passage 46 out through the exhaust port 64. The electronic engine control unit 70 varies the duty cycle of the retard control valve 60, and thus the closing of the supply port 62 is varied in inverse proportion to the opening of the exhaust port 64. For example, at one extreme, the supply port 62 is completely closed while the exhaust port 64 is completely open. This condition produces the maximum actuation rate of the vane phaser 12 because the direction and rate of actuation is controlled by the quantity of oil permitted to exhaust from the retard chambers 28R. The retard chambers 28R are permitted to exhaust so that the vane phaser 12 will shift to the advanced position by filling the advance chambers 28A at the same rate, and in similar fashion, as the exhausting of the retard chambers 28R.

Figure 2:
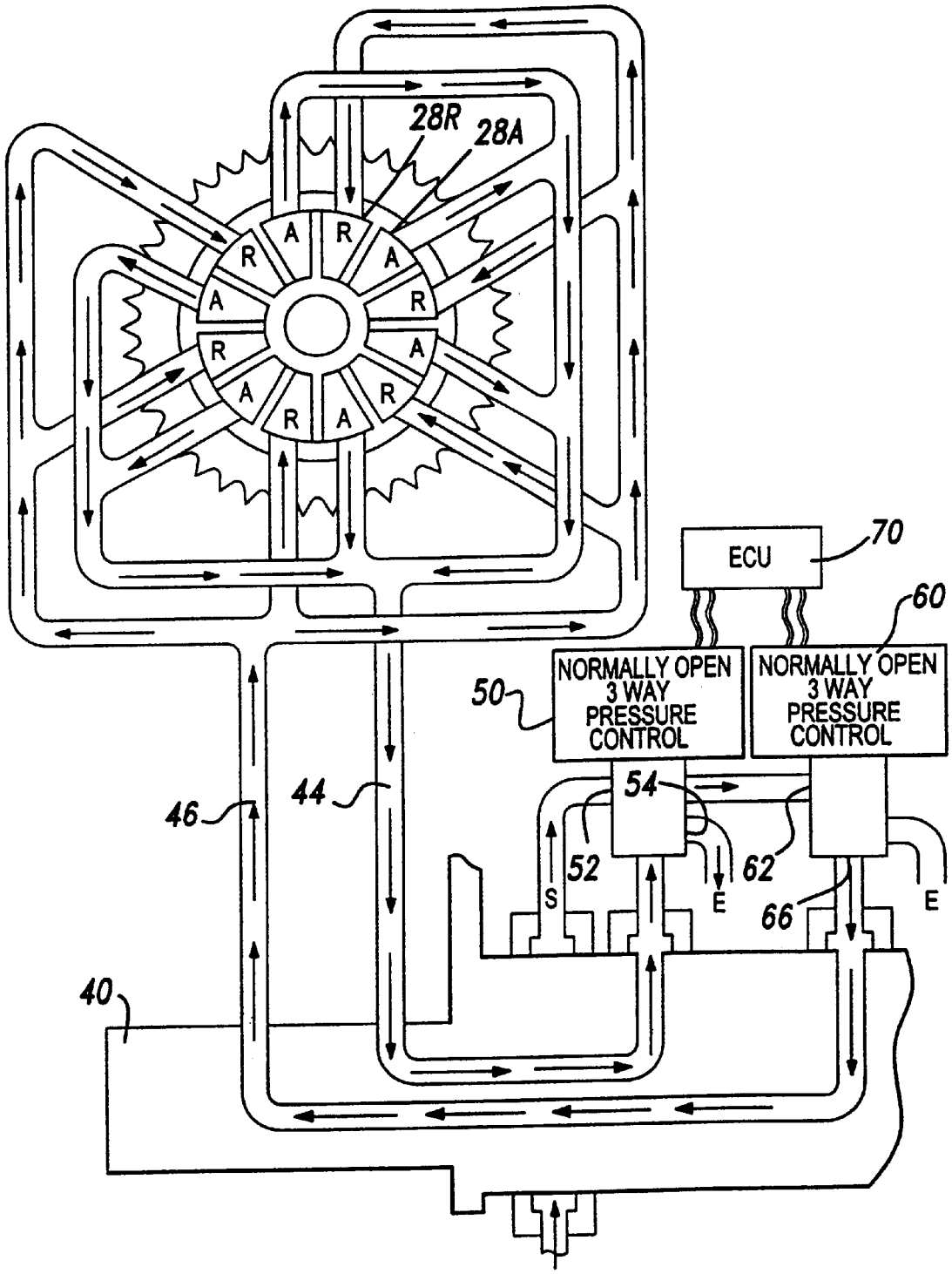
FIG. 2 is a schematic illustration of FIG. 1, showing a phase shift to a retard position.

As shown in FIG. 2, the camshaft 40 may also be shifted in phase toward a fully retarded position. Here, the electronic engine control unit 70 signals the retard control valve 50 to restrict the supply port 52 while opening the exhaust port 54, thereby permitting engine oil to exhaust from the advance chambers 28A through the advancing passage 44 out through the exhaust port 44. The electronic engine control unit 70 varies the duty cycle of the advance control valve 50, and thus the closing of the supply port 52 is varied in inverse proportion to the opening of the exhaust port 54. At one extreme, the supply port 52 is completely closed while the exhaust port 54 is completely open. This condition produces the maximum actuation rate of the vane phaser 12 as the direction and rate of actuation is controlled by the quantity of oil exhausting from the advance chambers 28A. Here, the advance chambers 28A are being exhausted so the vane phaser 12 will shift to the retarded position by filling the retard chambers 28R at the same rate, and in similar fashion, as the exhausting of the advance chambers 28A.

Figure 3:
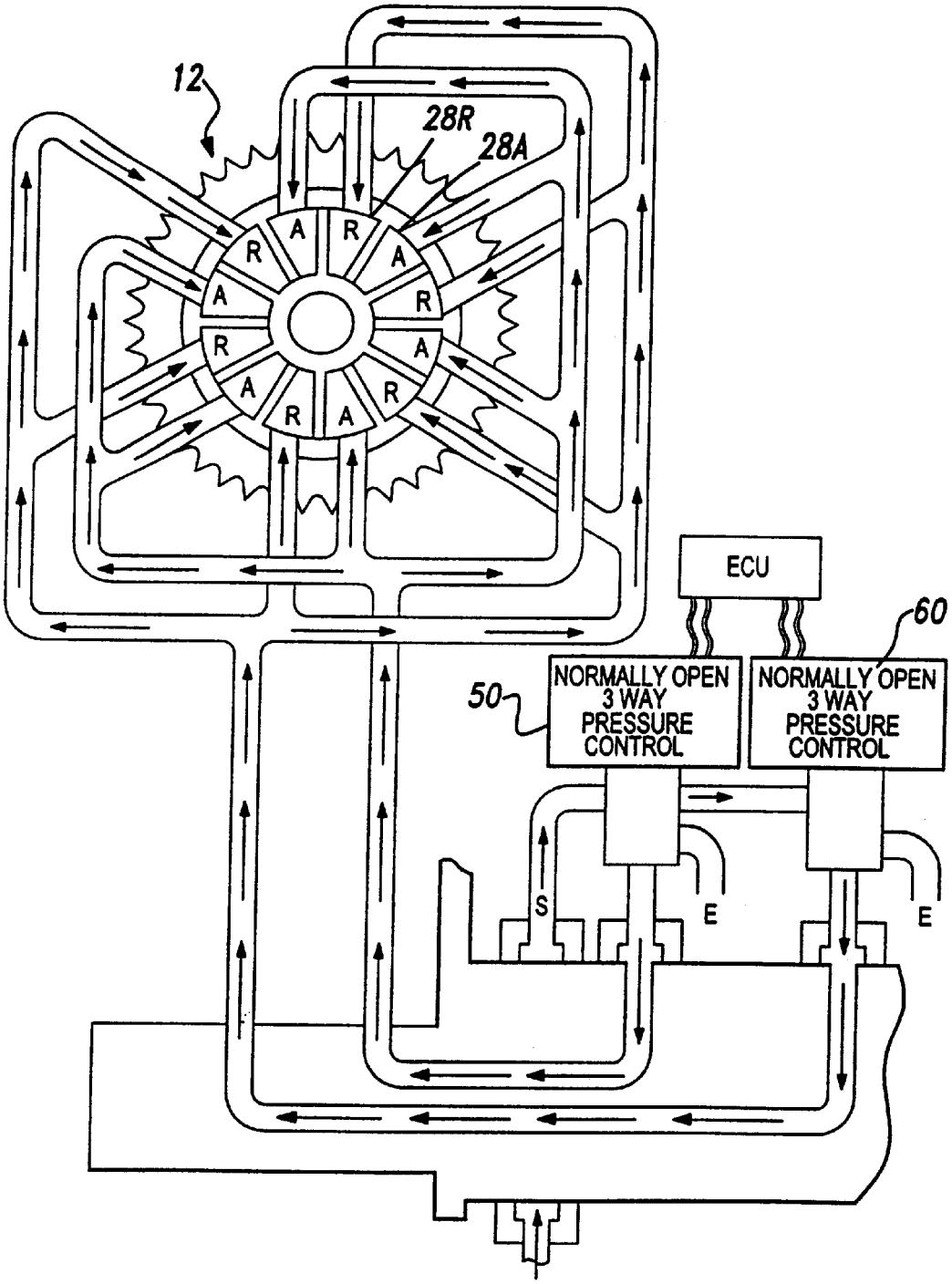
FIG. 3 is a schematic illustration of FIG. 1, showing the VCT maintaining position.

As shown in FIG. 3, the vane phaser 12 may maintain position anywhere in a multitude of intermediate positions between the fully advanced and retarded positions. To maintain position, there is a force balance between the oil pressure acting on the advance chambers 28A and the retard chambers 28R. Accordingly, the control valves 50 and 60 have high flow capacity and the output pressure of both the control valves 50 and 60 are increased to equally full pressure. To maintain the full pressure, the advance and retard control valves 50 and 60 are normally open.

Referring again to FIG. 1, for maximum advance actuation speed, full pressure is applied to the advance chambers 28A, whereas the retard chambers 28R are fully opened to exhaust. By adjusting the exhaust flow, however, the actuation speed of the vane phaser 12 can be adjusted. The exhaust flow is adjusted by increasing or decreasing the duty cycle. Accordingly, pressure to the chambers 28A and 28R decreases as duty cycle of the control valves 50 and 60 are increased, and vice versa. This control scheme results in the solenoid control valves 50 and 60 being turned off, yet supplying full pressure.

Figure 4:
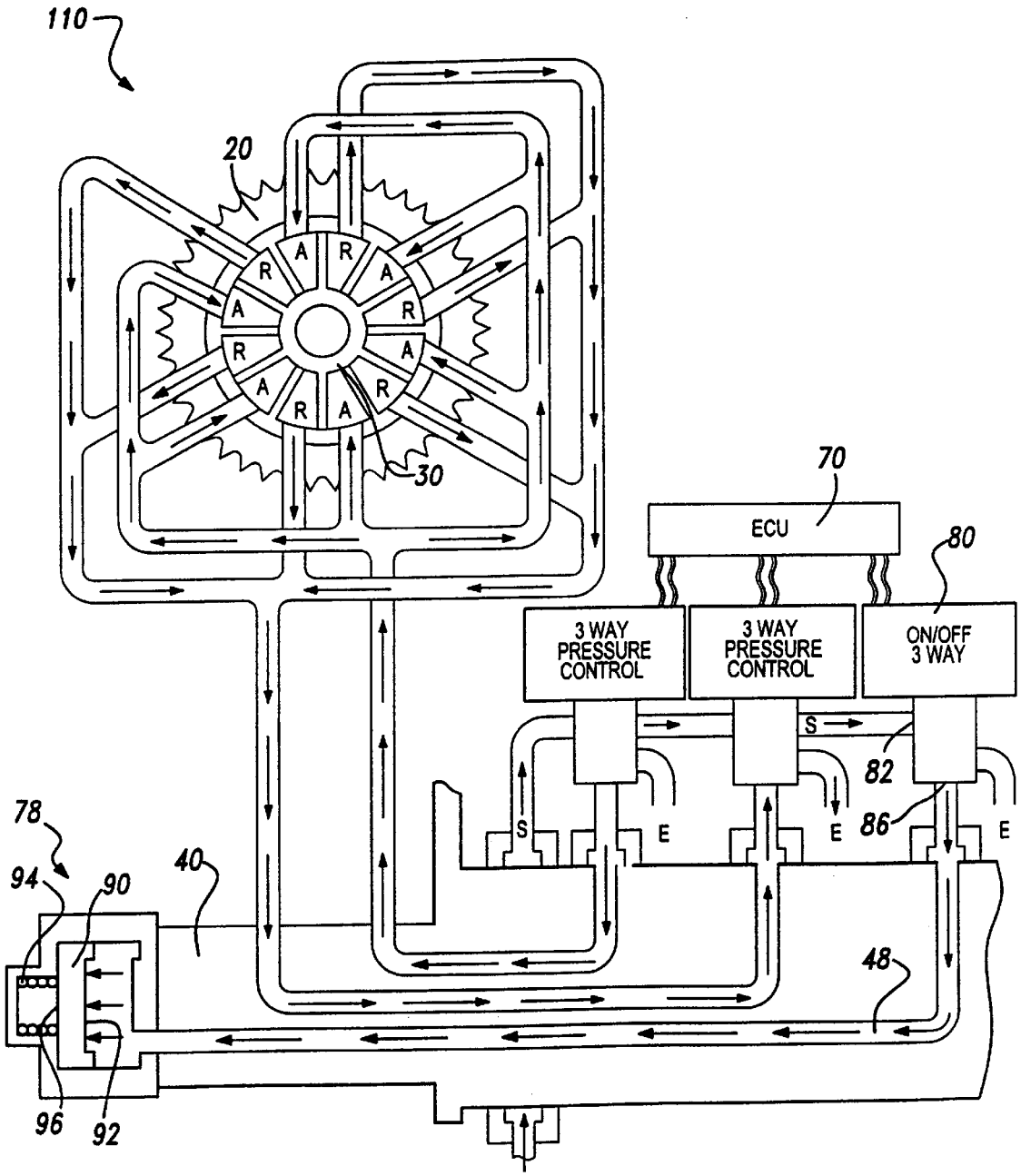
FIG. 4 is a schematic illustration of another Variable Camshaft Timing system according to an alternative embodiment of the present invention, showing a phase shift to an advance position.

FIG. 4 illustrates a locking VCT 110 according to an alternative embodiment of the present invention. Here, the locking VCT 110 includes all of the above-mentioned structural and operational characteristics and additionally includes a separate locking mechanism 78. The locking mechanism 78 is schematically illustrated and includes an on/off solenoid control valve 80 in electronic communication with the electronic engine control unit 70. The on/off solenoid control valve 80 is preferably a pulse width modulated valve and is also in fluid communication with a locking passage 48 running through the camshaft 40 and communicating with a locking piston 90. The locking piston 90 is engageable with the housing 20 in order to lock the hub 30 and housing 20 together as is well known in the art.

Figure 5:
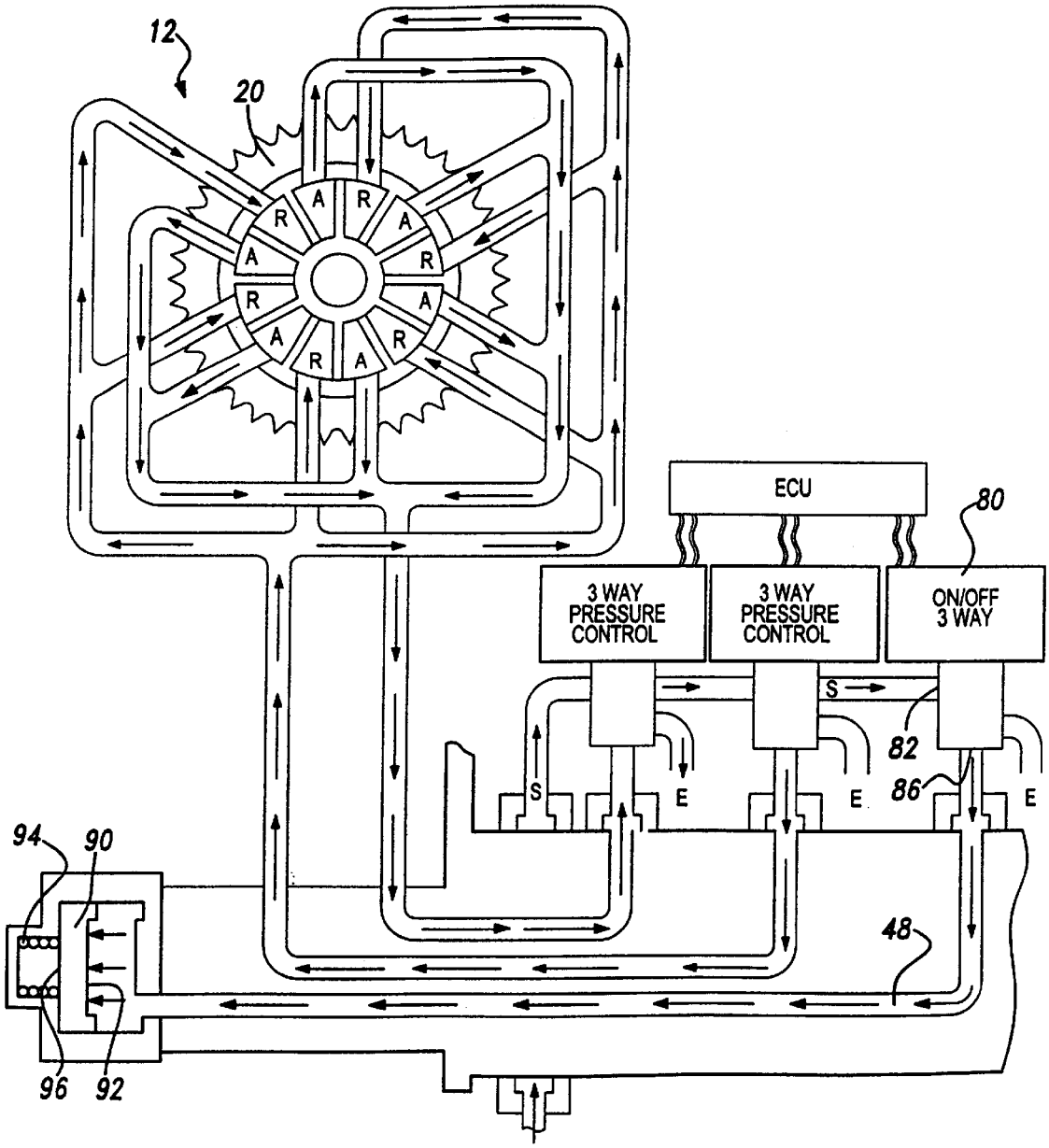
FIG. 5 is a schematic illustration of FIG. 4, showing a phase shift to a retard position.

In operation, the locking VCT 110 operates similarly to the VCT 10 of FIGS. 1 through 3. During phase shift to advance position or phase shift to retard position, as shown in FIGS. 4 and 5, the on/off solenoid control valve 80 ports engine oil through a supply port 82 and out of a locking port 86. The oil flows through the locking passage 48 and builds up pressure on a back side 92 of the locking piston 90 to overcome the force of a return spring 94 on a front side 96 of the locking piston 90, all in order to disengage the locking piston 90 from the housing 20. Consequently, the vane phaser 12 may oscillate freely between the fully advanced and fully retarded positions. Here, however, the vane phaser 12 maintains position differently than with the VCT 10 of the preferred embodiment.

Figure 6:
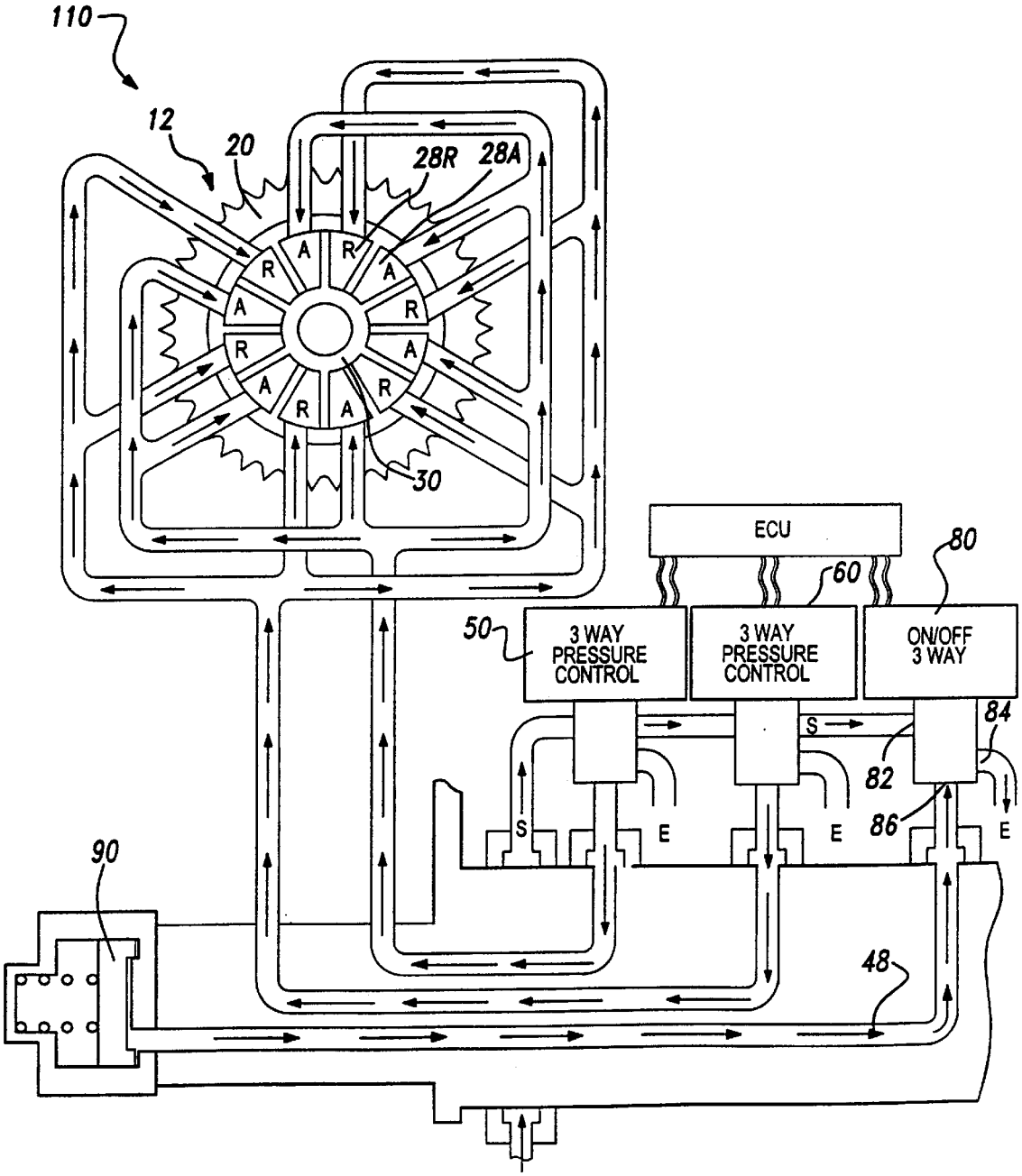
FIG. 6 is a schematic illustration of FIG. 4, showing the VCT in a locked up position.

As shown in FIG. 6, the on/off control solenoid 80 redirects engine oil through the supply port 82 and out an exhaust port 84 thereby pulling oil from the locking piston 90 through the locking passage 48 into the locking port 86 and back out the exhaust port 84. This causes the locking piston 90 to engage the housing 20 and thereby lock the housing 20 to the hub 30 to prevent relative rotation therebetween in the fully advanced, fully retarded, or intermediate positions therebetween. With regard to maintaining vane phaser 12 position, this effectively results in a mechanical positive locking configuration as in contrast to the hydraulic balancing configuration of the preferred embodiment.

Again, the exhaust flow is adjusted by increasing or decreasing the duty cycle. Accordingly, pressure to the chambers 28A and 28R increases as duty cycle of the control valves 50 and 60 increase, and vice versa. This control scheme results in the solenoid control valves 50 and 60 being turned on only to apply full pressure to change phase of the locking VCT 110 while the locking piston 90 is disengaged. Once the locking piston 90 re-engages, the solenoid control valves 50 and 60 are turned off and the pressure to the chambers 28A and 28R decrease.

From the above, it can be appreciated that a significant advantage of the present invention is that less complicated electronics and valves are required to achieve more accuracy and speed than ever before possible.

An additional advantage is that the control system of the present invention draws less electrical power and reduces oil consumption going to the phaser since the solenoid control valves are strategically designed to be in an off mode more often than not.

While the present invention has been described in terms of a preferred embodiment, it is apparent that other forms could be adopted by one skilled in the art. For example, the number of advance and retard control chambers could be different and different types of control valves could be used. Additionally, the reader's attention is directed to all papers and documents filed concurrently with or previous to this specification in connection with this application and which are open to public inspection with this specification, and the contents of all such papers and documents are incorporated herein by reference. Accordingly, the scope of the present invention is to be limited only by the following claims.

The present invention, in which an exclusive property or privilege is claimed, is defined as follows:

1. An internal combustion engine comprising:

a vane phaser (12); and means for controlling oscillation of said vane phaser (12), said means for controlling comprising:

advance valving means (50) for regulating engine oil pressure to and from said vane phaser (12);

retard valving means (60) for regulating engine oil pressure to and from said vane phaser (12);

advancing means (44) for communicating engine oil pressure between said advance valving means and said vane phaser (12); and retarding means (46) for communicating engine oil pressure between said retard valving means and said vane phaser (12); and wherein said advance valving means includes a normally-open solenoid control valve (50) comprising:

a supply port (52);

a control port (56) communicating with said supply port (52) and said advancing means; and an exhaust port (54) communicating with said supply port (52) and said control port (56); and wherein said retard valving means includes a normally-open solenoid control valve (60) comprising:

a supply port (62);

a control port (66) communicating with said supply port (62) and said retarding means; and an exhaust port (64) communicating with said supply port (62) of said retard valving means and said control port (66) of said retard valving means.

2. An internal combustion engine according to claim 1;

wherein said normally-open solenoid control valve (60) of said retard valving means comprises a three-way variable duty cycle solenoid valve;

wherein said normally-open solenoid control valve (50) of said advance valving means comprises a three-way variable duty cycle solenoid valve;

and further comprising an engine control unit (70) for varying the duty cycle of said solenoid control valve of said retard valving means and for varying the duty cycle of said solenoid control valve of said advance valving means.

3. The internal combustion engine as claimed in claim 1, wherein said vane phaser (12) can be locked in a fully advanced position, a fully retarded position, and in a plurality of intermediate positions therebetween.

4. The internal combustion engine as claimed in claim 1, wherein said vane phaser (12) can be locked in a fully advanced position, a fully retarded position, and in a plurality of intermediate positions therebetween.

5. The internal combustion engine as claimed in claim 3, further comprising locking means (78) for preventing oscillation of said vane phaser (12) in said fully advanced position, said fully retarded position, and in said plurality of intermediate positions therebetween, said locking means being reactive to engine oil pressure.

6. The internal combustion engine as claimed in claim 5, wherein said locking means comprises a locking piston (90) engageable with said vane phaser (12) under the bias of a return spring (94).

7. The internal combustion engine as claimed in claim 6, wherein said locking means further includes an on/off solenoid control valve (80) being in fluid communication with said locking piston (90) for distributing engine oil pressure to and from said locking piston (90).

8. The internal combustion engine as claimed in claim 7, wherein said advance valving means comprises a normally closed solenoid control valve (50) in fluid communication with said advancing means for distributing engine oil pressure to and from said advancing means.

9. The internal combustion engine as claimed in claim 8, wherein said retard valving means further comprises a normally closed solenoid control valve (60) in fluid communication with said retarding means for distributing engine oil pressure to and from said retarding means.

10. The internal combustion engine as claimed in claim 1, wherein said advancing and retarding means include neither a check valve nor a spool valve.

11. The internal combustion engine as claimed in claim 1, wherein said plurality of advance chambers are six in quantity and said plurality of retard chambers are six in quantity.

12. The internal combustion engine as claimed in claim 1, wherein said vane phaser is oscillatable in a range of no less than thirty degrees.

13. An internal combustion engine comprising:

a vane phaser (12); and means for controlling oscillation of said vane phaser (12), said means for controlling comprising:

advance valving means (50) for regulating engine oil pressure to and from said vane phaser (12);

retard valving means (60) for regulating engine oil pressure to and from said vane phaser (12);

advancing means (44) for communicating engine oil pressure between said advance valving means and said vane phaser (12); and retarding means (46) for communicating engine oil pressure between said retard valving means and said vane phaser (12);

wherein said vane phaser (12) can be locked in a fully advanced position, a fully retarded position, and in a plurality of intermediate positions therebetween; and further comprising locking means (78) for preventing oscillation of said vane phaser (12) in said fully advanced position, said fully retarded position, and in said plurality of intermediate positions therebetween, said locking means being reactive to engine oil pressure.

14. An internal combustion engine comprising:

a camshaft (40);

a hub (30) secured to said camshaft (40) for rotation therewith;

a housing (20) circumscribing said hub (30), said housing (20) being rotatable with said hub (30) and said camshaft (40) and being oscillatable with respect to said hub (30) and said camshaft (40);

a plurality of driving vanes (22) radially disposed in said housing (20) and cooperating with said hub (30);

a plurality of driven vanes (32) radially disposed in said hub (30) and alternating with said plurality of driving vanes (22) and cooperating with said housing (20);

said plurality of driving and driven vanes (22/32) defining a plurality of advance chambers (28A) and a plurality of retard chambers (28R); and means for controlling oscillation of said housing (20) relative to said hub (30), said means for controlling comprising:

an electronic engine control unit (70);

a three-way variable duty cycle solenoid advancing control valve (50) responsive to said electronic engine control unit (70) for regulating engine oil pressure to and from said plurality of advance chambers (28A);

a three-way variable duty cycle retarding control valve (60) responsive to said electronic engine control unit (70) for regulating engine oil pressure to and from said plurality of retard chambers (28R);

advancing means for communicating engine oil pressure between said advancing control valve (50) and said plurality of advance chambers (28A); and retarding means for communicating engine oil pressure between said retarding control valve (60) and said plurality of retard chambers (28R).

15. The internal combustion engine as claimed in claim 14, further comprising locking means for preventing relative motion between said housing and said hub in at least one position between a fully advanced position of said hub relative to said housing and a fully retarded position of said hub relative to said housing, said locking means being reactive to engine oil pressure.

16. The internal combustion engine as claimed in claim 15 further comprising means for disengaging said locking means and being adapted to receive engine oil pressure to permit oscillation of said housing (20) with respect to said camshaft (40) in response to engine oil pressure when said engine is in operation.

17. The internal combustion engine as claimed in claim 16, wherein said disengaging means comprises a passage extending through said camshaft for delivering a supply of engine oil pressure from said engine directly to said locking means, said supply of engine oil pressure acting against said locking means to disengage said locking means.

18. The internal combustion engine as claimed in claim 16, wherein said disengaging means comprises:

a control valve; and a passage extending through said camshaft for delivering a supply of engine oil pressure from said engine through said control valve, said supply of engine oil pressure acting against said locking means to disengage said locking means.

19. The internal combustion engine as claimed in claim 16, wherein said disengaging means comprises a passage extending through said camshaft for delivering a supply of engine oil pressure from said engine and extending through said means for controlling, said supply of engine oil pressure acting against said locking means to disengage said locking means.

20. The internal combustion engine as claimed in claim 13, wherein said locking means comprises a locking piston (90) engageable with said vane phaser (12) under the bias of a return spring (94).

21. The internal combustion engine as claimed in claim 20, wherein said locking means further includes an on/off solenoid control valve (80) being in fluid communication with said locking piston (90) and for distributing engine oil pressure to and from said locking piston (90).

22. The internal combustion engine as claimed in claim 21, wherein said advance valving means comprises a normally closed solenoid control valve (50) in fluid communication with said advancing means for distributing engine oil pressure to and from said advancing means.

23. The internal combustion engine as claimed in claim 21, wherein said retard valving means further comprises a normally closed solenoid control valve (60) in fluid communication with said retarding means for distributing engine oil pressure to and from said retarding means.

* * * * *